US010906781B2

(12) United States Patent
Chen et al.

(10) Patent No.: US 10,906,781 B2
(45) Date of Patent: Feb. 2, 2021

(54) PNEUMATIC VERTICAL TRANSPORTATION DEVICE

(71) Applicant: National Taiwan Normal University, Taipei (TW)

(72) Inventors: Jung-Hsuan Chen, Taipei (TW); Chin-Guo Kuo, Taipei (TW); Chao-Fu Shu, Taipei (TW)

(73) Assignee: National Taiwan Normal University, Taipei (TW)

( * ) Notice: Subject to any disclaimer, the term of this patent is extended or adjusted under 35 U.S.C. 154(b) by 436 days.

(21) Appl. No.: 15/993,077

(22) Filed: May 30, 2018

(65) Prior Publication Data

US 2019/0315598 A1 Oct. 17, 2019

(30) Foreign Application Priority Data

Apr. 12, 2018 (TW) ..... 107112633 A

(51) Int. Cl.
*B66B 9/04* (2006.01)
*B66B 11/04* (2006.01)

(52) U.S. Cl.
CPC ..... *B66B 9/04* (2013.01); *B66B 11/0423* (2013.01)

(58) Field of Classification Search
CPC ..... B66B 9/04; B66B 11/0423
See application file for complete search history.

(56) References Cited

U.S. PATENT DOCUMENTS 5,430,333 A * 7/1995 Binford ..... F03G 7/06 290/54
6,085,873 A * 7/2000 Macchi ..... B66B 9/04 187/273
10,106,375 B1 * 10/2018 Ascua ..... B66B 9/04
2002/0029938 A1 * 3/2002 Sors ..... B66B 9/04 187/345
2011/0127115 A1 * 6/2011 Stannah ..... F15B 21/005 187/272
2014/0014318 A1 * 1/2014 Mail ..... B66F 3/26 166/77.4
2014/0158469 A1 * 6/2014 Bisig ..... B66B 1/30 187/285
2014/0238781 A1 * 8/2014 Ascua ..... B66B 9/04 187/250

(Continued)

*Primary Examiner* — Michael A Riegelman
(74) *Attorney, Agent, or Firm* — Muncy, Geissler, Olds & Lowe, P.C.

(57) ABSTRACT

A pneumatic vertical transportation device comprises an expandable cylinder, a carriage rack, an air piping controller, and an air exhauster. The expandable cylinder includes a bellow body, with one end hanging carriage rack and the other end connected with a fixing plate. The expandable cylinder is connected with the air piping controller. While the carriage rack is rising, the air exhauster draws air from the bellow body through the air piping controller to gradually decrease pressure inside. Once pressure difference exceeds weight of the carriage rack, the carriage rack begins to rise. Volume of the expandable cylinder is reduced such that the lower disc of the expandable cylinder approaches top, and the expandable cylinder is maintained at low pressure state. While the carriage rack is descending, air is fed into the expandable cylinder through the air piping controller to gradually expand the bellow body, letting the carriage rack descend.

10 Claims, 7 Drawing Sheets

(56) References Cited

U.S. PATENT DOCUMENTS

| | | | | |
|---|---|---|---|---|
| 2015/0176617 | A1* | 6/2015 | Leamy | B66B 9/04 60/419 |
| 2017/0190424 | A1* | 7/2017 | Brown | B64D 9/00 |
| 2017/0260031 | A1* | 9/2017 | Hunt | B66B 9/04 |
| 2019/0315598 | A1* | 10/2019 | Chen | B66B 11/0423 |
| 2020/0080548 | A1* | 3/2020 | Kuo | F04B 39/123 |
| 2020/0262677 | A1* | 8/2020 | Samba Murthy | B66B 1/30 |

* cited by examiner

PNEUMATIC VERTICAL TRANSPORTATION DEVICE

This application claims priority for Taiwan patent application no. 107112633 filed on Apr. 12, 2018, the content of which is incorporated by reference in its entirety.

BACKGROUND OF THE INVENTION

Field of the Invention

The present invention relates to a vertical transportation device, particularly to a pneumatic vertical transportation device, wherein the pressure difference between the atmospheric pressure and the internal pressure of the expandable cylinder is used to lift or lower the transportation device.

Description of the Related Art

The electric elevator, also called the lift or vertical elevator, is a device for vertically transporting passengers or goods. Passenger transportation is the most common application of electric elevators. The capacity of a passenger elevator correlates with the area and application of the building, normally ranging from hundreds of kilograms to two thousand kilograms. A building of four or less stories may adopt a hydraulic elevator. The electric elevator of a building of ten or less stories normally operates at a speed of 1.5 m/sec (5.4 km/h). The electric elevator of a building of ten or more stories may operate at a speed of as high as 2.5 m/sec (9 km/h) or even 6 m/sec (21.6 km/h).

The driving systems of the current elevators may be classified into the traction type, the hydraulic type and the pneumatic type. The traction type elevator is driven by an electric motor or gears and needs a machine room on the top of the elevator shaft thereof. Therefore, the application of the traction type elevator is limited. The hydraulic type elevator consumes much electric power, operates at a lower speed, and generates noise. Therefore, the hydraulic type elevator is hard to be popularized. The pneumatic type elevator is driven by pressure difference to run inside an airtight elevator shaft, exempted from using steel cables or plungers. Because of having an airtight structure, the car of a pneumatic type elevator can run between the topmost end and the bottommost end of the elevator shaft like the plunger of a syringe. The pneumatic type elevator is free of a pit and has a simpler structure.

The conventional pneumatic type elevator is driven by a high-pressure compressed air or a low-pressure vacuum to move inside a cylinder having a fixed volume. The car of the conventional pneumatic type elevator tightly contacts the inner wall of the cylinder. A great friction exists there in between, consuming much power and generating much heat. Such a problem has persisted for a long time in the conventional pneumatic type elevator, and the manufacturers are eager to solve the problem.

In order to solve the abovementioned problems, many aspects must be taken into consideration. According to many years' experience in the related field, the Inventor deems that those problems are possible to overcome. Dedicated to researching the problems and based on the related theorems, the Inventor proposes a novel pneumatic vertical transportation device, which can avoid the abovementioned problems. The principles and embodiments of the present invention will be described in detail below.

SUMMARY OF THE OF INVENTION

One objective of the present invention is to provide a pneumatic vertical transportation device to solve the conventional problem: the conventional pneumatic type elevator is driven by a high-pressure compressed air or a low-pressure vacuum to move inside a cylinder having a fixed volume, which induces a great friction force between the car and the cylinder. The pneumatic vertical transportation device of the present invention is characterized in using the pressure difference between the interior and exterior of an expandable cylinder to control a carriage rack to move up and down.

Another objective of the present invention is to provide a pneumatic vertical transportation device, which uses an air exhauster to draw air from an expandable cylinder and generate a pressure difference between the interior and exterior of the expandable cylinder, whereby the pressure difference lifts up the carriage rack. While the air exhauster stops operation and an air piping controller feeds air into the expandable cylinder, the pressure difference lets the carriage rack descend.

In order to achieve the abovementioned objectives, the present invention proposes a pneumatic vertical transportation device, which comprises an expandable cylinder, a carriage rack, an air piping controller, and an air exhauster. The expandable cylinder includes an upper disc, a lower disc and a bellow body. The upper disc and the lower disc are respectively arranged on an upper end and a lower end of the bellow body. A flexible air-impermeable material is connected with the upper disc and the lower disc to form the bellow body whose volume is variable and expandable. The carriage rack is hanged to the bottom of the bellow body of the expandable cylinder. The air piping controller is connected with the bellow body by an air pipe and controls the pressure inside the bellow body. The air exhauster is connected with the air piping controller. While the air exhauster draws air from the bellow body through the air piping controller, the pressure difference between the interior and exterior of the bellow body drives the carriage rack to rise. While the air exhauster stops operation and the air piping controller feeds air into the bellow body, the pressure difference between the interior and exterior of the bellow body lets the carriage rack descend.

In one embodiment, the expandable cylinder is disposed vertically or horizontally. In the case that the expandable cylinder is disposed vertically, the lower disc is connected with a connecting rod and hangs the carriage rack using the connecting rod. In the case that the expandable cylinder is disposed horizontally, the lower disc is connected with a steel cable, and the steel cable is passed over a pulley to connect with the connecting rod and hangs the carriage rack using the connecting rod.

The upper disc of the expandable cylinder is connected with a fixing plate and maintained at a fixed position. In one embodiment, the fixing plate is fixed to the ceiling or side wall of a higher floor; the air piping controller controls the pressure inside the bellow body of the expandable cylinder to enable the carriage rack to move up and down between the higher floor and the ground of a lower floor.

The air piping controller includes an air exhausting valve, at least one air feeding valve, at least one interconnection valve, and at least one quantification air cylinder. One end of the air exhausting valve is connected with an air pipe, and another end of the air exhausting valve is connected with the air exhauster. One end of the air feeding valve is connected with the air pipe; another end of the air feeding valve is connected with one end of the quantification air cylinder; another end of the quantification air cylinder is connected with the interconnection valve. The air feeding valve is able to interconnect with the atmosphere.

While the air feeding valve and the interconnection valve are closed and the air exhausting valve is opened, the air exhauster begins to draw air from the bellow body of the expandable cylinder to gradually decrease the pressure inside the bellow body, gradually reduce the volume of the expandable cylinder, and lift up the carriage rack.

While the expandable cylinder reaches a low pressure state, the air exhausting valve is closed, and the air feeding valve and the interconnection valve are opened. Then, the quantification air cylinder gradually feeds air into the bellow body of the expandable cylinder to gradually expand the bellow body and let the carriage rack descend.

Below, embodiments are described in detail in cooperation with the attached drawings to make easily understood the objectives, technical contents, characteristics and accomplishments of the present invention.

DETAILED DESCRIPTION OF THE INVENTION

The summary stated above and the embodiments mentioned below are used to explain and exemplify the spirits and principles of the present invention, which the claims are based on. Thereinafter, the embodiments of the present invention will be described in detail in cooperation with the attached drawings to demonstrate the characteristics, implementations and efficacies of the present invention.

Figure 1A:
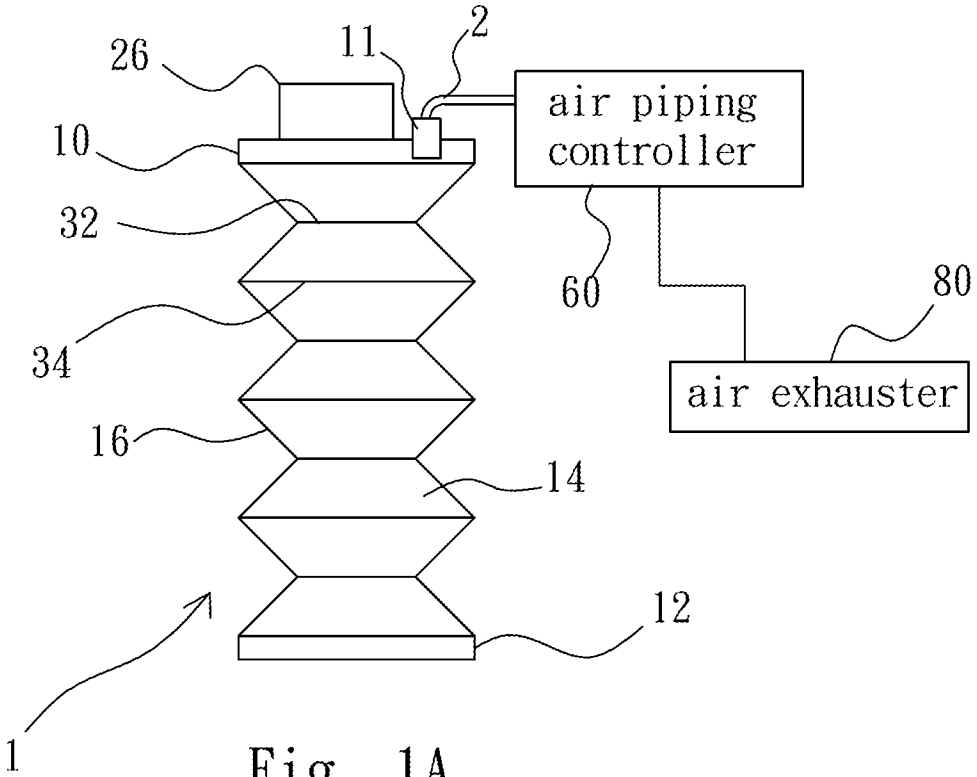
FIG. 1A is a diagram schematically showing the structure of an expandable cylinder according to one embodiment of the present invention.
Figure 1B:
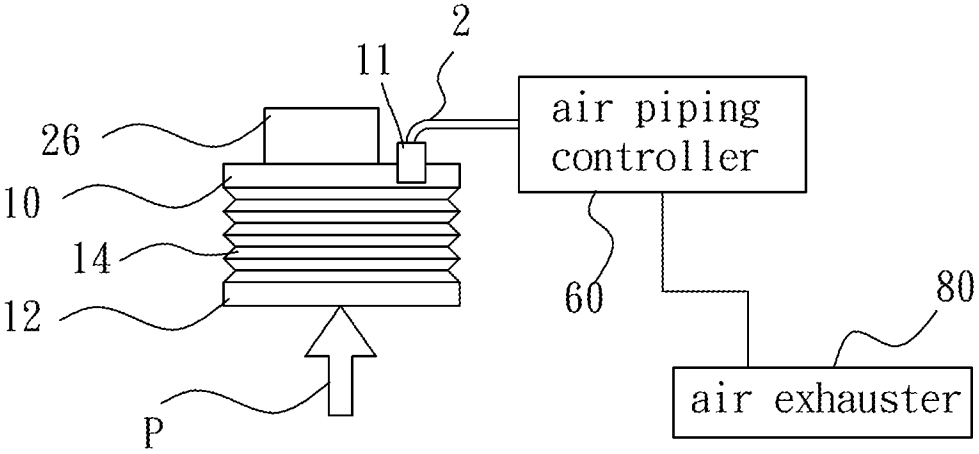
FIG. 1B is a diagram schematically showing the structure of a compressed expandable cylinder according to one embodiment of the present invention.

One objective of the present invention is to make use of the atmospheric pressure to realize the function of a vertical transportation device in a low energy consumption rate. The atmospheric pressure is normally about 1 $Kg/cm^2$. Because P=F/A, the force F is proportional to the area A. Suppose that the radius of the area is 50 cm. The total force acting on the area is 7500 Kg. If the air inside an airtight chamber is sucked out to gradually reduce the internal pressure thereof, the pressure difference between the internal pressure and the atmospheric pressure and the total force acting on the airtight chamber by the atmospheric pressure will be gradually increased. Refer to FIG. 1A and FIG. 1B for the structure of an expandable cylinder according to one embodiment of the present invention.

In the embodiment shown in FIG. 1A and FIG. 1B, the expandable cylinder 1 includes an upper disc 10, a lower disc 12, and a bellow body 14. The upper disc 10 and the lower disc 14 are respectively arranged on the upper end and lower end of the bellow body 14. The upper disc 10 and the lower disc 12 are connected by an air-impermeable flexible material 16. Thereby, the bellow body 14 can extend or retract to increase or decrease the volume thereof. First rings 32 and second rings 34 are arranged on the bellow body 14, and each pair of adjacent first ring 32 and second ring 34 are separated by a distance. In one embodiment, the first ring 32 and the second ring 34 are made of a rigid material. The first ring 32 and the second ring 34 respectively have different radiuses. The first rings 32 and the second rings 34 are arranged alternatingly on the below body 14.

Figure 3:
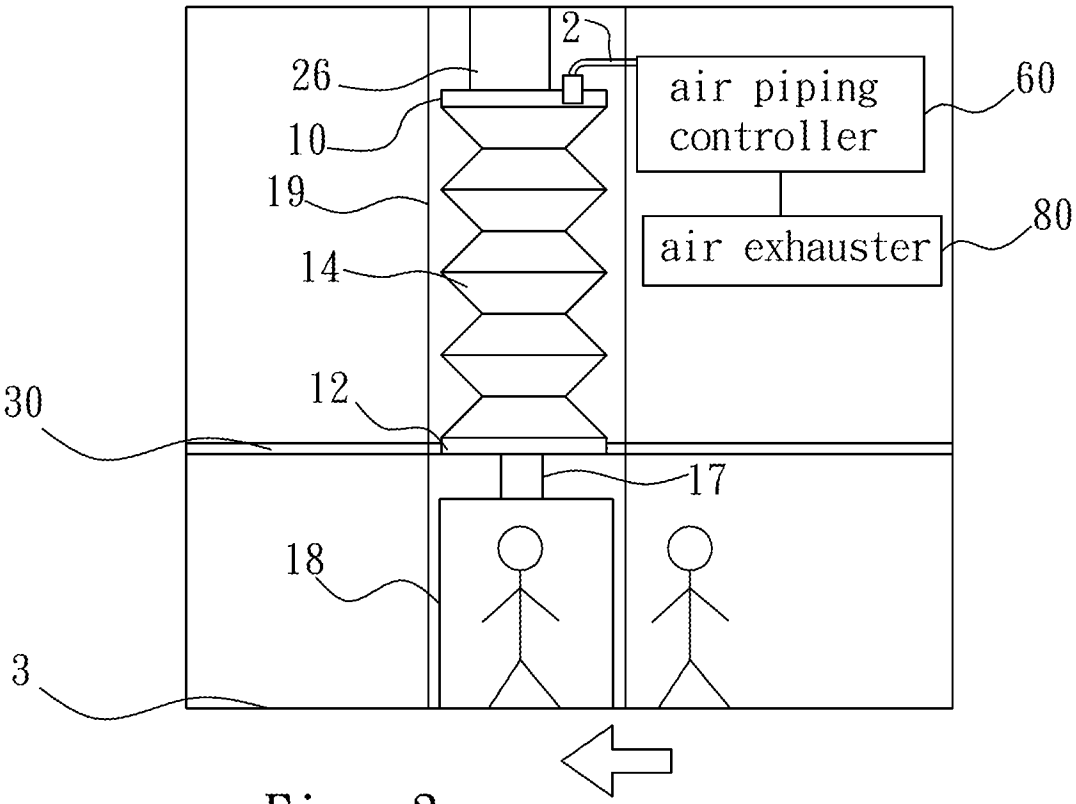
FIG. 3 is a diagram schematically showing an expandable cylinder disposed vertically according to one embodiment of the present invention.
Figure 4:
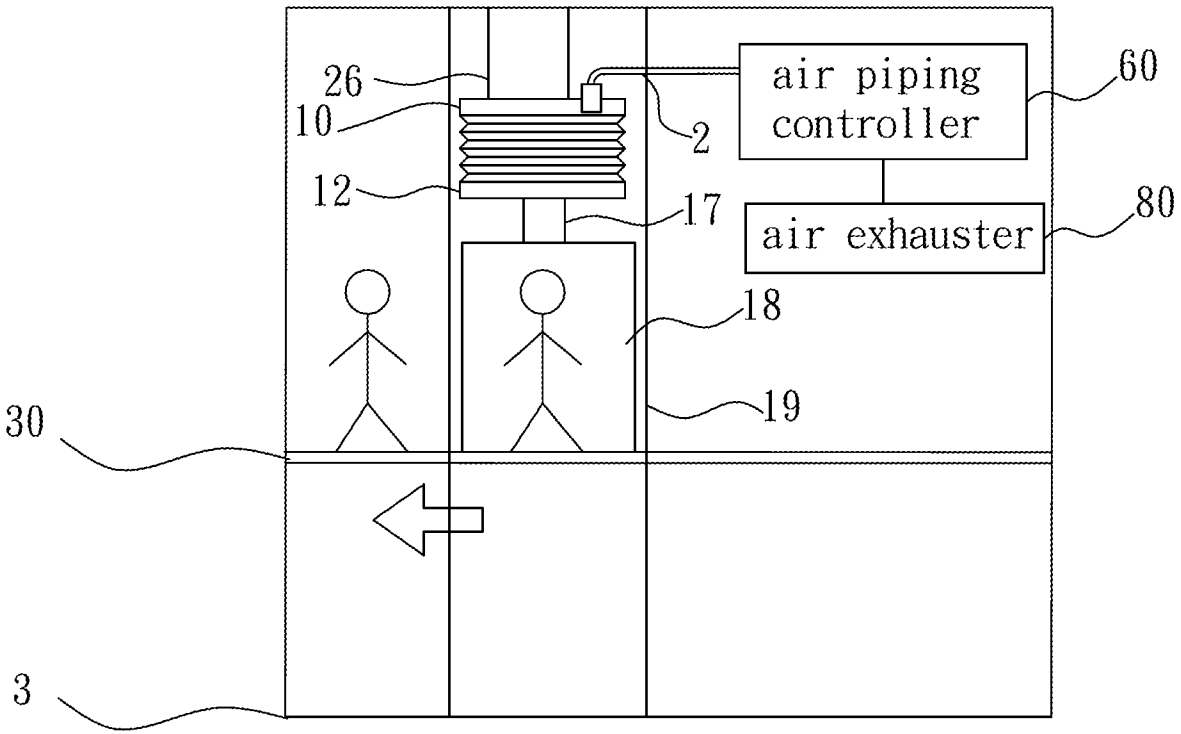
FIG. 4 is a diagram schematically showing that the expandable cylinder shown in FIG. 3 undertakes lift-up according to one embodiment of the present invention.

The upper disc 10 is connected with a fixing plate 26 and maintained at a fixed position. The upper side of the bellow body 14 has an air hole 11. An air piping controller 60 is connected with the air hole 11 through an air pipe 2 and thus interconnected with the bellow body 14 of the expandable cylinder 1. The other end of the air piping controller 60 is connected with an air exhauster 80. The present invention varies the pressure inside the bellow body 14 of the expandable cylinder 1 mainly using the operations of the air piping controller 60 and the air exhauster 80. As shown in FIG. 1B, while the air exhauster 80 draws air from the bellow body 14 through the air piping controller 60, the atmospheric pressure pushes the lower disc 12 and thus reduces the volume of the bellow body 14. Refer to FIG. 3 and FIG. 4 diagrams schematically showing a vertical-type expandable cylinder according to one embodiment of the present invention. In the embodiment shown in FIG. 3 and FIG. 4, the expandable cylinder 1 is vertically installed; the lower disc 12 is connected with a connecting rod 17; the lower disc 12 hangs a carriage rack 18 using the connecting rod 17. In the embodiment shown in FIG. 3 and FIG. 4, the fixing plate 26 is fixed to a higher floor, such as the ceiling of the second floor 30; the carriage rack 18 is placed on the ground of the first floor 3; the carriage rack 18 can move up and down inside a motion space 19.

Figure 2:
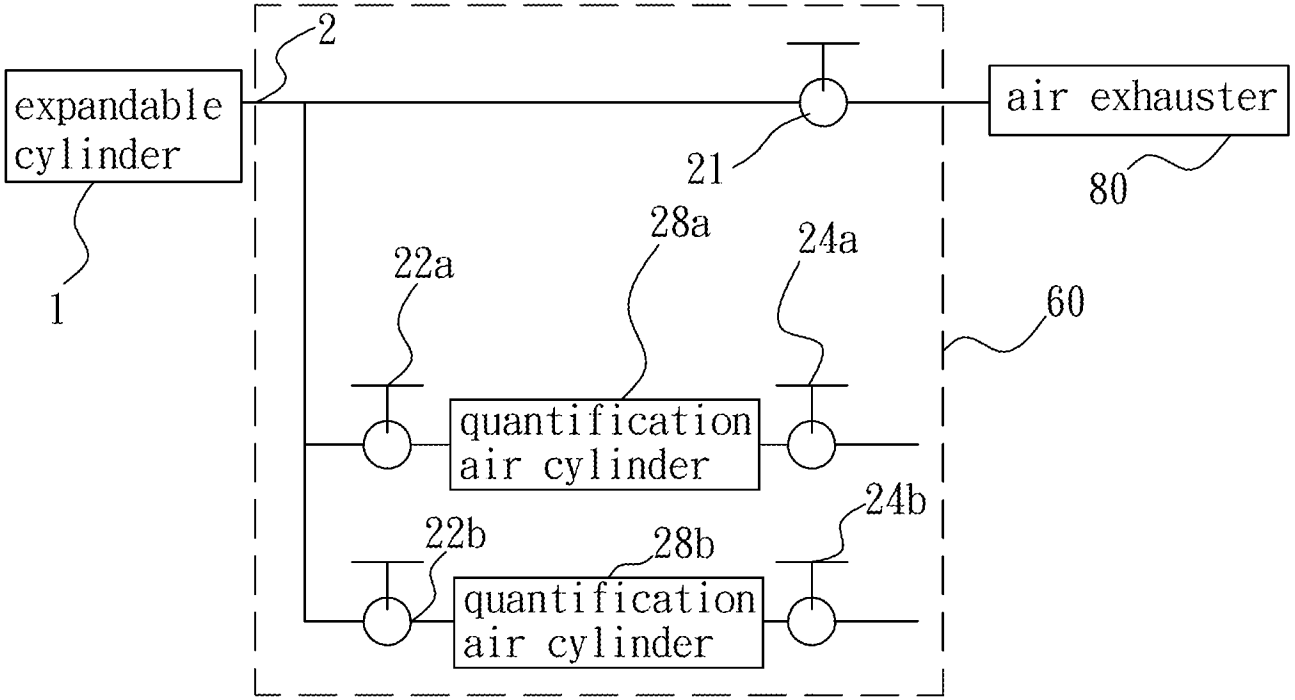
FIG. 2 is a diagram schematically showing an air piping controller according to one embodiment of the present invention.

Refer to FIG. 2 a diagram schematically showing the system of an air piping controller according to one embodiment of the present invention. In the embodiment shown in FIG. 2, the air piping controller 60 includes an air exhausting valve 21, at least one air feeding valve 22*a*/22*b*, at least one interconnection valve 24*a*/24*b*, and at least one quantification air cylinder 28*a*/28*b*. One end of the air exhausting valve 21 is connected with the air pipe 2, and the other end of the air exhausting valve 21 is connected with the air exhauster 80. In one embodiment, the air piping controller 60 includes two air feeding paths interconnected with each other; one of air feeding paths includes the air feeding valve 22*a*, the quantification air cylinder 28*a*, and the interconnection valve 24*a*; the other one of air feeding paths includes the air feeding valve 22*b*, the quantification air cylinder 28*b*, and the interconnection valve 24*b*. In other embodiments of the present invention, the air piping controller 60 may have more than three air feeding paths or only a single air feeding path. All these embodiments can realize the present invention. However, the present invention is not limited by these embodiments. Any person having ordinary knowledge in the art should be able to make modification or variation of these embodiments without departing from the scope of the present invention.

In one embodiment, one end of the air feeding valve 22*a* is connected with the air pipe 2; the other end of the air feeding valve 22*a* is connected with one end of the quantification air cylinder 28*a*; the other end of the quantification air cylinder 28*a* is connected with the interconnection valve 24*a*; thus, the air feeding valve 22*a* is able to interconnect with the atmosphere. In the same embodiment, one end of the air feeding valve 22*b* is connected with the air pipe 2; the other end of the air feeding valve 22*b* is connected with one end of the quantification air cylinder 28*b*; the other end of the quantification air cylinder 28*b* is connected with the interconnection valve 24*b*; thus, the air feeding valve 22*b* is able to interconnect with the atmosphere. Refer to FIG. 4. While the carriage rack 18 is to rise, the air piping controller 60 opens the air exhausting valve 21 and closes the air feeding valves 22*a* and 22*b* and the interconnection valves 24*a* and 24*b*. Then, the air exhauster 80 draws air from the bellow body 14 to reduce the pressure inside the bellow body 14 and decrease the volume of the expandable cylinder 1 gradually. Thus, the difference between and the internal pressure of the expandable cylinder 1 and the atmospheric pressure increases gradually. Finally, the net force acting on the lower disc 12 exceeds the weight of the carriage rack 18, and the carriage rack 18 begins to rise.

While the expandable cylinder 1 reaches a lower pressure state, the volume thereof is reduced to such an extent that the lower disc 12 approaches the top. Then, the air exhausting valve 21 is closed, and at least one air feeding path, i.e. at least one of the air feeding valves 22*a* and 22*b* and at least one of the interconnection valves 24*a* and 24*b*, is opened. Thus, the air inside at least one of the quantification air cylinders 28*a* and 28*b* gradually enters the bellow body 14 of the expandable cylinder 1. Consequently, the bellow body 14 gradually expands, the net force acting on the bellow body 14 gradually decreases, and the carriage rack 18 hanged to the bellow body 14 begins to descend. In general, the air inflow to the expandable cylinder 1 is modified according to the load of the carriage rack 18.

Figure 5:
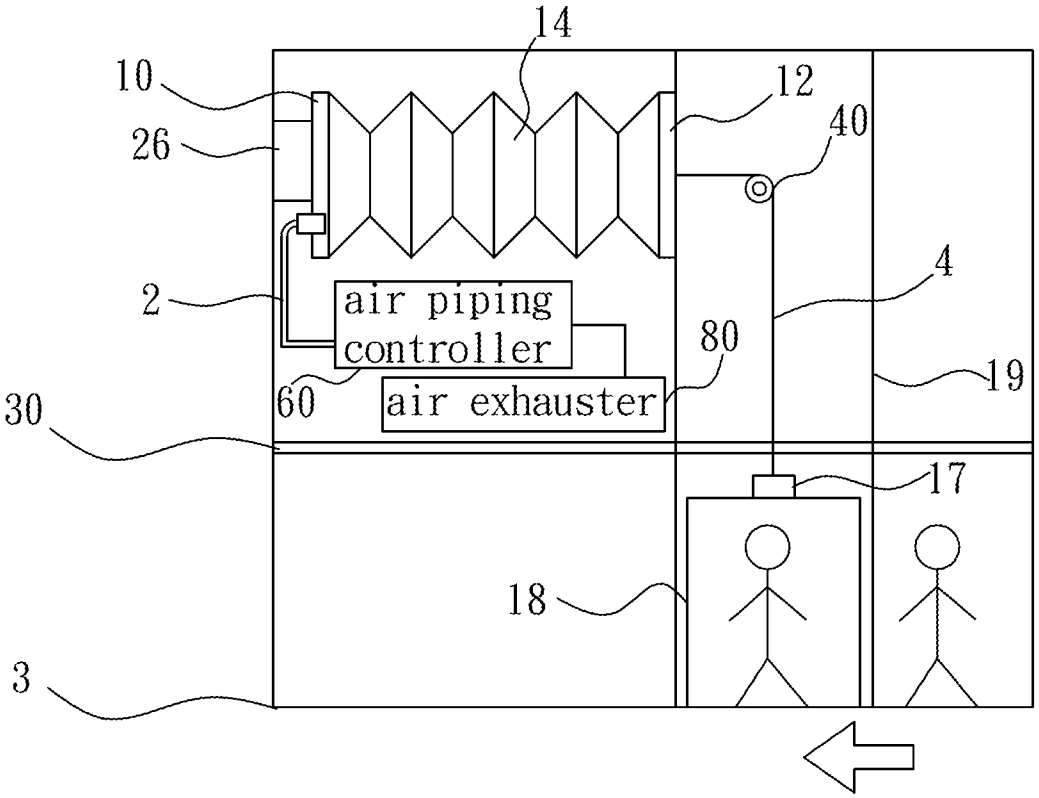
FIG. 5 is a diagram schematically showing an expandable cylinder disposed horizontally according to one embodiment of the present invention.
Figure 6:
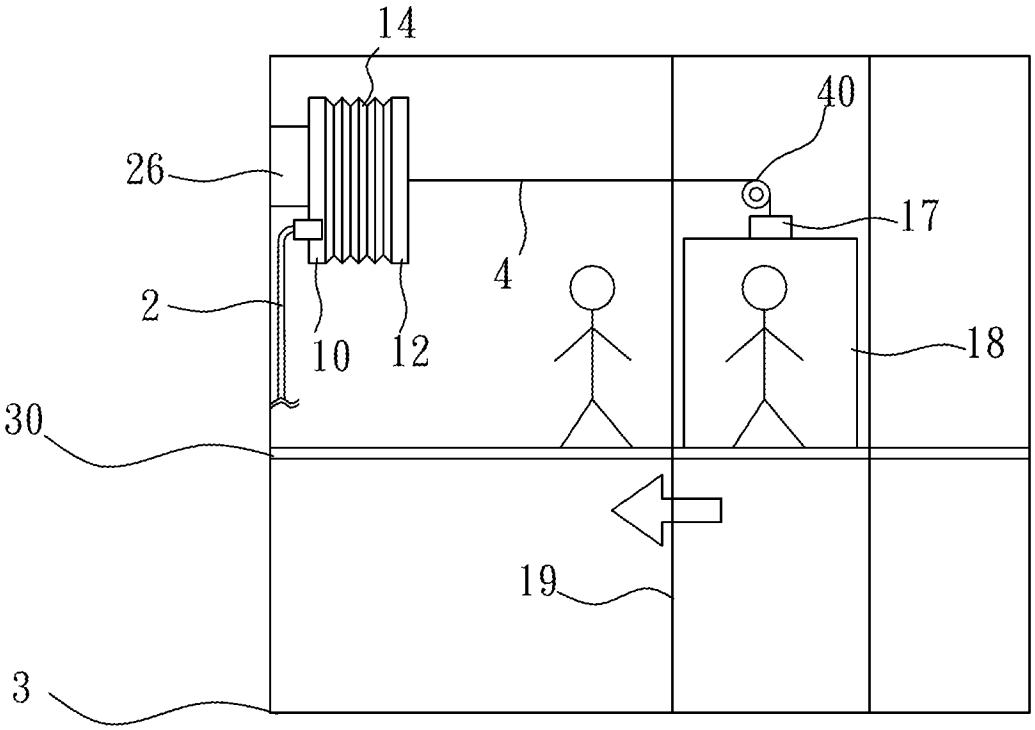
FIG. 6 is a diagram schematically showing that the expandable cylinder shown in FIG. 5 undertakes lift-up according to one embodiment of the present invention.

Refer to FIG. 5 and FIG. 6 diagrams schematically showing a horizontal-type expandable cylinder according to one embodiment of the present invention. In the embodiment shown in FIG. 5 and FIG. 6, the expandable cylinder 1 is installed horizontally; the lower disc 12 is connected with a steel cable 4; the steel cable 4 is connected with the connecting rod 17 through a pulley 40; the connecting rod 17 hangs the carriage rack 18. In the embodiment shown in FIG. 5 and FIG. 6, the fixing plate 26 is fixed to a higher floor, such as the sidewall of the second floor 30; the carriage rack 18 is placed on the ground of the first floor 3; the carriage rack 18 can move up and down inside a motion space 19.

Refer to FIG. 6. While the carriage rack 18 is to rise, the air piping controller 60 opens the air exhausting valve 21 and closes the air feeding valves 22*a* and 22*b* and the interconnection valves 24*a* and 24*b*. Then, the air exhauster 80 draws air from the bellow body 14 to reduce the pressure inside the bellow body 14 and decrease the volume of the expandable cylinder 1 gradually. Thus, the difference between and the internal pressure of the expandable cylinder 1 and the atmospheric pressure increases gradually. Then, the net force acting on the lower disc 12 gradually increases to approach the force acting on the carriage rack 18 in the opposite direction. The atmospheric force acting on the lower disc 12 is transmitted to the carriage rack 18 through the steel cable 4. Finally, the atmospheric force acting on the lower disc 12 exceeds the weight of the carriage rack 18 and the load, and the carriage rack 18 begins to rise.

While the expandable cylinder 1 reaches a lower pressure state, the volume thereof is reduced to such an extent that the lower disc 12 approaches one side of the expandable cylinder 1. Then, the air exhausting valve 21 is closed, and at least one air feeding path, i.e. at least one of the air feeding valves 22*a* and 22*b* and at least one of the interconnection valves 24*a* and 24*b*, is opened. Thus, the air inside at least one of the quantification air cylinders 28*a* and 28*b* gradually enters the bellow body 14 of the expandable cylinder 1. Consequently, the bellow body 14 gradually expands, the net force acting on the bellow body 14 gradually decreases, and the carriage rack 18 hanged to the bellow body 14 begins to descend. In general, the air inflow to the expandable cylinder 1 is modified according to the load of the carriage rack 18.

In conclusion, the present invention proposes a pneumatic vertical transportation device, which comprises an expandable cylinder, a carriage rack, an air piping controller, and an air exhauster. While the air exhauster draws air from the expandable cylinder through the air piping controller, the pressure difference between the interior and the exterior of the bellow body of the expandable cylinder drives the carriage rack to rise. While the air exhauster stops and the air piping controller feeds air into the expandable cylinder, the pressure difference between the interior and the exterior of the bellow body of the expandable cylinder allows the carriage rack to descend. Compared with the conventional technologies, the present invention can efficiently drive the carriage rack to rise or descend, neither using high-pressure compressed air nor using low-pressure vacuum, not only making the user operate it easily but also effectively decreasing the cost and complexity of fabrication.

Besides, the present invention can solve the problem of too high a friction force of the conventional carriage rack and avoid the problems of consuming too much energy and generating too much heat.

Therefore, the pneumatic vertical transportation device of the present invention indeed has high utility and superior competitiveness. The technical characteristics, means and efficacies of the present invention are significantly different from those of the conventional technologies. The persons skilled in the art are unlikely to realize the present invention easily. Therefore, the present invention meets the condition for a patent. It will be appreciated by the Inventors if the examiners approve the patent fast.

What is claimed is:

1. A pneumatic vertical transportation device comprising an expandable cylinder including an upper disc, a lower disc and a bellow body, wherein said upper disc and said lower disc are respectively arranged on an upper end and a lower end of said bellow body; a flexible air-impermeable material is connected with said upper disc and said lower disc to form said bellow body which is expandable;

a carriage rack hanged to a bottom of said bellow body of said expandable cylinder;

an air piping controller connected with said bellow body by an air pipe and controlling pressure inside said bellow body;

an air exhauster connected with said air piping controller, wherein while said air exhauster draws air from said bellow body, a pressure difference between interior and exterior of said bellow body drives said carriage rack to rise; while said air exhauster stops drawing air and said air piping controller feeds air into said bellow body instead, said pressure difference between said interior and said exterior of said bellow body allows said carriage rack to descend.

2. The pneumatic vertical transportation device according to claim 1, wherein first rings and second rings are alternatingly disposed in said bellow body; said first ring and said second ring respectively have different radiuses; said first ring is separated from said second ring adjacent to said first ring by a specified distance.

3. The pneumatic vertical transportation device according to claim 2, wherein said first rings and said second rings are made of a rigid material.

4. The pneumatic vertical transportation device according to claim 1, wherein said upper disc is connected with a fixing plate and maintained at a fixed position.

5. The pneumatic vertical transportation device according to claim 4, wherein said expandable cylinder is disposed vertically; said lower disc is connected with a connecting rod and hangs said carriage rack using said connecting rod.

6. The pneumatic vertical transportation device according to claim 4, wherein said expandable cylinder is disposed horizontally; said lower disc is connected with a steel cable; said steel cable is passed through a pulley and connected with a connecting rod; said steel cable hangs said carriage rack using said connecting rod.

7. The pneumatic vertical transportation device according to claim 4, wherein said fixing plate is fixed to a ceiling of a higher floor; said air piping controller controls pressure inside said bellow body to lift or lower said carriage rack between a lower floor and said higher floor.

8. The pneumatic vertical transportation device according to claim 7, wherein said carriage rack moves up and down inside a motion space.

9. The pneumatic vertical transportation device according to claim 1, wherein said air piping controller further comprises an air exhausting valve, at least one air feeding valve, at least one interconnection valve, and at least one quantification air cylinder; one end of said air exhausting valve is connected with said air pipe, and another end of said air exhausting valve is connected with said air exhauster; one end of said at least one air feeding valve is connected with said air pipe; another end of said at least one air feeding valve is connected with one end of said at least one quantification air cylinder; another end of said at least one quantification air cylinder is connected with said at least one interconnection valve; said at least one air feeding valve is able to interconnect with the atmosphere; while said air exhausting valve is opened and said at least one air feeding valve and said at least one interconnection valve are closed, said air exhauster draws air from said bellow body to reduce pressure inside said bellow body and decrease volume of said expandable cylinder gradually to lift said carriage rack; while said expandable cylinder reaches a lower pressure state, said air exhausting valve is closed, and said at least one air feeding valve and said at least one interconnection valves are opened; air inside said at least one quantification air cylinder gradually enters said bellow body to expand said volume of said expandable cylinder and lower said carriage rack.

10. The pneumatic vertical transportation device according to claim 9, wherein said air piping controller includes two said quantification air cylinders, two said air feeding valves and two said interconnection valves, which form two parallel air feeding paths.

* * * * *